US009359133B2

(12) United States Patent
Rea

(10) Patent No.: US 9,359,133 B2
(45) Date of Patent: Jun. 7, 2016

(54) TANKS AND METHODS OF CONSTRUCTING TANKS

(76) Inventor: James Robert Rea, Katikati (NZ)

( * ) Notice: Subject to any disclaimer, the term of this patent is extended or adjusted under 35 U.S.C. 154(b) by 393 days.

(21) Appl. No.: 13/451,740

(22) Filed: Apr. 20, 2012

(65) Prior Publication Data

US 2012/0211496 A1 Aug. 23, 2012

Related U.S. Application Data

(62) Division of application No. 12/194,337, filed on Aug. 19, 2008, now abandoned.

(51) Int. Cl.

| | |
|---|---|
| ***B21D 51/06*** | (2006.01) |
| ***B65D 90/52*** | (2006.01) |
| ***B21D 51/18*** | (2006.01) |

(52) U.S. Cl.

CPC ..... *B65D 90/52* (2013.01); *B21D 51/06* (2013.01); *B21D 51/18* (2013.01); *Y10T 29/49* (2015.01); *Y10T 29/49826* (2015.01); *Y10T 29/49879* (2015.01)

(58) Field of Classification Search

CPC ..... B21D 39/02; B21D 39/028; B21D 51/06; B21D 51/18; B21D 51/20; B21D 26/46; B65D 90/52; Y10T 29/49879

USPC ..... 72/379.2, 379.4; 413/2, 26, 27

See application file for complete search history.

(56) References Cited

U.S. PATENT DOCUMENTS

| | | | | | |
|---|---|---|---|---|---|
| 2,210,654 | A | * | 8/1940 | Dickson | 72/329 |
| 2,982,441 | A | * | 5/1961 | Farrell et al. | 220/652 |
| 3,172,386 | A | * | 3/1965 | West | 72/368 |
| 3,208,658 | A | * | 9/1965 | Membrino | 229/117.01 |
| 3,265,022 | A | * | 8/1966 | Kaufman | 72/29.2 |
| 3,587,163 | A | * | 6/1971 | Horton | 228/154 |
| 3,937,363 | A | * | 2/1976 | Anderson | 222/105 |
| 4,062,312 | A | * | 12/1977 | Mason | 413/4 |
| 4,328,694 | A | * | 5/1982 | Beaumont | 72/368 |
| 4,546,492 | A | * | 10/1985 | Dickenson | 2/46 |
| 4,552,612 | A | * | 11/1985 | Fortuna et al. | 156/494 |
| 4,830,271 | A | * | 5/1989 | Lau et al. | 229/117 |
| 5,075,951 | A | * | 12/1991 | Schurr et al. | 29/428 |
| 5,314,088 | A | * | 5/1994 | Heuberger et al. | 229/117.3 |
| 5,779,092 | A | | 7/1998 | Hehn et al. | |

(Continued)

FOREIGN PATENT DOCUMENTS

| | | |
|---|---|---|
| JP | 04327175 | 11/1992 |
| WO | WO 01/79082 | 10/2001 |

OTHER PUBLICATIONS

Official Action for U.S. Appl. No. 12/194,337, mailed Feb. 24, 2011 6 pages Restriction Requirement.

(Continued)

*Primary Examiner* — Edward Tolan

(74) *Attorney, Agent, or Firm* — Andrew M. Calderon; Roberts Mlotkowski Safran & Cole, P.C.

(57) ABSTRACT

There is provided a method of constructing a tank which provides an improvement in the strength of the tank. Therefore, tanks can be constructed from thinner materials providing lighter tanks which are more capable of withstanding explosions or other trauma.

In addition, the tank is more suited for use in vehicles as it effectively controls unwanted movement of fluid within the tank.

12 Claims, 3 Drawing Sheets

(56) References Cited

U.S. PATENT DOCUMENTS

| | | | | |
|---|---|---|---|---|
| 5,803,302 | A * | 9/1998 | Sato et al. | 229/117.3 |
| 5,820,718 | A | 10/1998 | Dean | |
| 5,979,686 | A | 11/1999 | Dean | |
| 6,076,480 | A | 6/2000 | Chang et al. | |
| 6,338,420 | B1 | 1/2002 | Pachciarz et al. | |
| 6,357,617 | B1 | 3/2002 | Kido | |
| 6,547,503 | B1 * | 4/2003 | Bohm et al. | 413/4 |
| 7,028,382 | B2 | 4/2006 | Fisher et al. | |
| 7,552,838 | B2 * | 6/2009 | McDowell | 220/495.01 |
| 7,923,634 | B2 * | 4/2011 | Yokawa | 174/50 |
| 8,844,450 | B2 * | 9/2014 | Dull et al. | 111/120 |
| 2005/0178768 | A1 | 8/2005 | Woollen, Jr. | |
| 2006/0163258 | A1 | 7/2006 | Fisher et al. | |
| 2007/0017918 | A1 | 1/2007 | Kirk | |
| 2009/0297740 | A1 * | 12/2009 | Durney | 428/34.1 |
| 2010/0045017 | A1 | 2/2010 | Rea | |

OTHER PUBLICATIONS

Official Action for U.S. Appl. No. 12/194,337, mailed Apr. 28, 2011 7 pages.

Official Action for U.S. Appl. No. 12/194,337, mailed Nov. 17, 2011 10 pages.

* cited by examiner

TANKS AND METHODS OF CONSTRUCTING TANKS

CROSS-REFERENCE TO RELATED APPLICATIONS

The present application is a divisional of U.S. patent application Ser. No. 12/194,337, filed Aug. 19, 2008, entitled "IMPROVEMENTS IN TANKS AND METHODS OF CONSTRUCTING TANKS" which is incorporated herein by this reference in its entirety for at least the purposes of enablement and written description.

TECHNICAL FIELD

The present invention relates to methods of constructing tanks for holding liquids, and in particular storage tanks for use in vehicles.

BACKGROUND ART

The weight of tanks is often sought to be reduced by making the walls thinner and/or from lighter materials such as plastic sheet. Using lighter/thinner materials however can consequently lead to a decrease in the strength of the tank. The tanks are therefore prone to bulging and deformation when carrying a load.

It would therefore be beneficial to have a tank which has a both strong and light weight construction. Preferably, the tank whilst having relatively thin walls may still provide a robust construction, which is the same, or substantially similar, to that achieved with heavier tanks. In addition, a light weight tank construction which can better withstand damage that would occur from explosive, or other, forces that could cause rupture, would be advantageous.

Many tanks used in vehicles have a large capacity. As the vehicle moves, this causes the liquid in the tank to also move resulting in "sloshing" which can adversely effect the vehicle's movement as it alters the centre of gravity. This is of particular concern in boats where the relative orientation is important in its performance.

To combat "sloshing" baffles are used in tanks control the flow of liquid in the tank. U.S. Pat. No. 7,028,382 is one example of a method of constructing a tank with baffles. According to this patent, a framework is first constructed having plates which provide the end walls of the tank, and baffles transverse and longitudinal to the length of the tank.

The body of the tank is completed by wrapping sheet material around the framework to form the tank's side and bottom walls. A top is subsequently secured over the framework and to the edges of the side walls.

However, tanks produced using the method disclosed by this patent are particularly weak as the top is only welded to the side and end walls In addition, the baffles formed by the initially constructed framework are ineffective at controlling movement of liquid in the tank. This is because the liquid is still able to run up the sides of the baffles and therefore alter the centre of gravity of the tank.

Therefore, it would be a benefit to have a method of constructing a stronger tank made from thin and/or light weight materials.

Further, it would be advantageous to have a tank having baffles which better control the movement of liquid within the tank.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to a first aspect of the present invention, there is provided a method of constructing a tank, including the steps of:

(a) forming a body portion having at least one opening in at least one side;

(b) sealing the opening(s) with one or more section(s) of material which has/have larger dimensions than said opening(s);

characterised in that the section(s) of material is/are located on the inside of the opening(s).

According to a further aspect of the present invention, there is provided a tank which includes:

a body portion having at least one opening;

wherein the opening(s) is/are sealed by one or more section(s) of material which has/have larger dimensions than that of the opening;

characterised in that the section is located on the inside of the opening.

According to a another aspect of the present invention, there is provided a vehicle with a tank which includes:

a body portion having at least one opening, base, side and end walls;

wherein the opening is sealed by one or more section(s) of material which has/have larger dimensions than that of the opening;

characterised in that the section is/are located on the inside of the opening(s).

In a preferred embodiment the tank may be made of plastic type materials such as copolymer polypropylene, high molecular weight polyethylene, or the like. For ease of reference, the sheet material will be referred to as being plastic.

Alternatively the sheet material may be thin metallic materials such as steel or aluminum.

It should be appreciated that the sheet material should be compatible with the type of liquid to be stored in the tank. For example some liquids dissolve plastic materials and they are the two are not compatible. Therefore, a high molecular weight polyethylene may be used when the tank is to store fuel, or copolymer polypropylene where the tank is to store black water. The plastic materials used with the present invention may be varied as appropriate.

Preferably, the tanks constructed according to the present invention may be formed by securing a number of separate components to each other.

In a particularly preferred embodiment, securing the various components forming the tank may be achieved by plastic welding as known to those skilled in the art.

Alternatively, adhesives, resins, or glues, as known to those skilled in the art could be used to secure the components of the tank to each other.

In a preferred embodiment, the body portion may be formed at least partially by folding sheet material.

In one preferred embodiment, the sheet material may be folded to provide at least two side walls and a base of the body portion.

In some preferred embodiments sheet material providing end walls for the tank may be secured to the side walls and base.

In yet a further embodiment, the sheet material may be folded to provide a body portion having a shape similar to a cylinder.

Alternatively, the body portion may be formed by welding sections of sheet material to each other to provide side walls and a base for the body portion.

In other preferred embodiments the sheet material, the base and side walls may also be further folded to create end walls.

Preferably, the sheet material forming the end walls may have a shape substantially corresponding to the cross-section of the open ends formed by the side walls and base of the body portion.

However, this should not be seen as limiting and alternatives for the shape of the sheet material are envisaged as long as they provide end walls for the tank once constructed.

In a preferred embodiment, the end walls may be welded to the body portion along their internal edges and external edges.

In a particularly preferred embodiment, the body portion may have a first pair of flanges which partially extend across the top of the body portion and/or a second and third pair of opposed flanges which partially extend across each of the open ends of the side walls that extend from the base of the body portion.

In some preferred embodiments a further pair of flanges may be created on the edges of the end walls.

In a particularly preferred embodiment, the flanges may be formed along at least part of the top edge of at least two opposed walls by folding the sheet material forming the body portion. The second and third pair of opposed flanges on the end wall may be formed by folding the side edges of the opposed walls. In this embodiment, the flanges are integral to the body portion and the opposed walls.

An advantage of the integral flanges is that they remove the need to attach additional sheet material to the edges of the tank. Such attachments are a potential point of failure, and therefore the integral flanges provide additional strength to the tank as will become apparent from the ensuing description.

In a preferred embodiment, forming the tank may include the step of forming a top section for the tank.

Preferably, the top section is secured to the underside of the first pair of flanges.

Preferably, the top section may have at least one aperture of relatively large dimensions with respect to the dimensions of the top wall of the tank.

One advantage of having at least one relatively large aperture is it that it allows a user access inside the tank to weld the internal and external edges of the top section to the side and end walls of the tank. Therefore, the top section can be more securely attached to the tank improving its strength. In addition, if the tank has baffles, the top section can be welded to these further increasing the tank's strength.

In a particularly preferred embodiment, the top section may have a plurality of apertures. This allows a person access to the inside of the tank to weld the top section to each edge of the tank, and the edges of any baffles within the tank.

The step of sealing the tank according to the present invention may involve inserting a section of material through each aperture in the top section and arranging this so that it completely covers the aperture. The sheet of material is then secured to the edges of the aperture thereby sealing the opening of the tank.

It should be appreciated that the section of material is of a size so that there is an overlap with the edges of the apertures of the top section. This overlap region should be sufficient so that the section of material can rest against, and be supported by, the edges of the aperture. Thus, this construction for sealing of the opening of the tank provides more strength than relying on a weld or adhesive alone. The inventor believes that this limits damage that may be caused by a rupture.

According to a second aspect of the present invention, there is provided a method of constructing a tank for use in a vehicle, including the steps of:

(a) forming at least the side, end, and base of the tank, (b) positioning and securing a baffle within said tank so that the baffle can have a substantially horizontal orientation when the tank is installed in the vehicle.

According to a further aspect of the present invention, there is provided a tank, including:

a baffle, characterised in that the baffle has a substantially horizontal orientation, with respect to the in use orientation of the tank, within a vehicle.

According to another aspect of the present invention, there is provided a vehicle with a tank, wherein the tank includes:

a baffle, characterised in that the baffle is substantially parallel to at least one horizontal axis of the vehicle's predominant in use position.

Most preferably the baffle is sub parallel to both horizontal axes of the vehicle's predominant in use position.

In a particularly preferred embodiment, the tank according to the second aspect of the present invention may be constructed according to the first aspect of the invention.

Throughout the body of the present specification, reference to the term "baffle" should be understood as a partition within the tank.

Preferably, the baffle may be formed from the same sheet material as the tank.

Alternatively, the baffle may be made from materials of different widths, or other shapes which help to control the movement of fluid within the tank.

Having substantially horizontal baffles in a tank is advantageous as they affect the movement of liquid in the tank. The substantially horizontal baffle acts to limit the uncontrolled movement of liquid up the edges of the tank or vertical baffles when a vehicle changes direction suddenly.

This reduces the unwanted "sloshing" effect and limits changes to the centre of gravity.

In a preferred embodiment, the tank may also have one or more substantially vertical baffles.

In a particularly preferred embodiment, the baffles may divide the tank into compartments of substantially equal volume. This ensures that the tank is reinforced at regular spacings and that the baffles help to limit bulging of the tank when full. This allows thinner sheet material to be used in forming the tank. The baffles also create compartments of lesser volume than the tank as a whole. This helps to limit unwanted movement of liquid in the tank and sloshing.

In preferred embodiments two or more vertical baffles may be orthogonally positioned with respect to one another.

Most preferably, the substantially vertical baffles may be positioned so as to be effectively either longitudinally or latitudinally orientated with respect to the tank.

In preferred embodiments the step of securing latitudinal, longitudinal and substantially horizontal baffles may be repeated.

In this embodiment, the substantially horizontal baffles may be positioned so that they touch the top edges of the latitudinal and longitudinal baffles.

In a particularly preferred embodiment, the substantially horizontal baffle may have a series of apertures which correspond to the compartments defined by the latitudinal and longitudinal baffles.

The substantially horizontal baffle may be welded to the edges of the tank and the latitudinal and longitudinal baffles. The apertures in the baffle allows welding on both sides of the baffle, improving the tanks strength.

In a particularly preferred embodiment, the shape of the apertures in the substantially horizontal baffle may be substantially symmetrical.

In a particularly preferred embodiment, the apertures in the substantially horizontal baffles may be round.

Ideally the apertures may be symmetrically positioned in the baffle.

Preferably, the apertures may be positioned substantially centrally with respect to the corresponding compartment.

However, this should not be seem as limiting and alternatives for the apertures in the substantially horizontal baffles are envisaged including triangular or square apertures, or those not positioned substantially at the centre of the baffle.

The inventor has found that having baffles with a symmetrical shape and which are symmetrically positioned may improve the strength of the tank. This may be because the distance between the edge of the aperture and the wall of the tank is substantially equal, providing equal strength in every direction. This helps to minimise bulging, deformation, and points of weakness.

In addition, having one aperture in the baffle corresponding to each compartment helps to limit the sloshing of liquid within the tank. If a vehicle suddenly changes direction, the fluid also changes direction. However, using the present invention, as the fluid moves, it encounters the substantially horizontal baffles. This stops it running up the edge of the tank's wall. Overall, this limits the sloshing of fluid within the tank due to changes in direction to the vehicle.

Preferably, the apertures may have a size and shape sufficient to allow a person access to the compartment below the substantially horizontal baffle. This allows the person to weld the bottom edge of the baffle to the portion. The inventor believes that this improves the strength of the tank.

In a preferred embodiment, the steps of positioning and securing baffles may be repeated.

It should be appreciated that the repetition of these steps forms a series of compartments which are above and below each other. Reference herein will be made to the compartments which are above and below each other as defining cylinders in the tank.

It should be understood that the number of times these steps are repeated depends on the size of the tank, and the dimensions of the compartments defined by the baffles.

At this point, the latitudinal and longitudinal baffles may be substantially flush with the internal edge of the side wall(s). When used with the first aspect of the present invention the latitudinal and longitudinal baffles may be substantially flush with the internal edge of body portion's flanges.

It is then possible to seal the tank by securing a top wall to the side and end walls of the tank.

In a particularly preferred embodiment, sealing the tank may occur in accordance with the first aspect of the present invention discussed above.

According to a third aspect of the present invention, there is provided a tank, including:

a series of compartments within the tank, at least one opening interconnecting adjacent compartments, characterised in that the opening is positioned at or near an edge of a compartment.

According to a another aspect of the present invention, there is provided a vehicle with a tank, the tank including:

a series of compartments within the tank, at least one opening interconnecting adjacent compartments, characterised in that the passage way is positioned at or near an edge of a compartment.

Preferably in use, the tank is installed in a vehicle so that the opening is at the lowest point of each compartment.

In a preferred embodiment, the opening may be formed in the transverse and/or longitudinal baffles.

Preferably, the opening may be located at, or near, the bottom edge of a longitudinal, or latitudinal, baffle in a position corresponding to a compartment.

Alternatively, a passage way may be formed from a gap between the bottom edge of a baffle and the side and/or base of the tank.

In a particularly preferred embodiment, there may be a series of compartments above and below each other formed by latitudinal, longitudinal, and substantially horizontal baffles.

In this embodiment, each compartment may be connected to the compartments directly above and below thereby forming a cylinder.

In this embodiment, adjacent cylinders are interconnected only by a passage way at the lowest point in the tank when in use.

Having the passage way at the lowest point of the tank is advantageous as fluid is only capable of moving between the compartments and cylinders at this point. This limits the lateral movement of fluid in the tank and reduces the unwanted "sloshing" of the fluid.

It is also envisaged that the tank may not have a series of cylinders, but rather two or more compartments which are connected via passage ways at the lowest point of the tank.

Throughout the body of the present specification, reference to the term "lowest point of the tank" should be understood as meaning the bottom of the tank when it is installed in a vehicle.

The inventor has found that connecting compartments and cylinders at the lowest point of the tank decreases the build up of contaminate matter within the tank. For example, liquid within the tank continually moves towards the lowest point of the tank. As it does so, the liquid takes particulate matter and flushes this from the tank.

This may be particularly beneficial in tanks for holding black water which have a high concentration of particulate matter.

It may also help to ensure that water is continually flushed from fuel tanks. The build up of water within a tank is an issue as this can affect the quality of fuel stored within the tank.

In a particularly preferred embodiment, the tank may have a plurality of exhaust ports positioned towards the top of the tank when secured in a vehicle. The operation of the exhaust ports may be as is well known in the art in relation to those used in fuel tanks or boats.

The exhaust ports allow venting of excess vapors within the tank. This helps to ensure that the tank does not explode or rupture due to a build up of pressure within the tank.

In addition, the exhaust ports allow the liquids within the tank to be removed therefrom use or disposal.

Yet a further advantage of having the passage way interconnecting adjacent compartments at the lowest point of the tank is that it may lower excess venting of fumes through the tank's exhaust ports.

This may be due to the passage way facilitating efficient movement of liquid between compartments which therefore decreases the build up of excessive vapor within the tank.

It should be appreciated from the foregoing description that the present invention has a number of advantages. Firstly, the present invention provides a method of constructing tanks from thin sheet material. Therefore, these tanks are lighter and better suited for use in vehicles.

In addition, the configuration of baffles, and sealing the tank with a section of material located inside the tank may provide increases in strength. This helps the tanks to better withstand the pressure of containing a fluid. In addition, the tanks may be stronger and better able to withstand explosions.

In addition, the present invention also decreases the sloshing of fluid within the tank.

The inventor has found that preferred embodiments of the present invention can have one or more advantages over tanks constructed using previously available methods. These include:

- the tanks are light weight and easy to construct.
- using substantially horizontal baffles help to limit bulging of the tank when full.
- the substantially horizontal baffles also help to limit sloshing of liquid in the tank. The tanks are therefore well suited for use in vehicles such as boats.
- the costs of construction are limited through decreasing the labour, skill, and materials needed to construct a tank for use in a vehicle.
- the tanks are generally better able to withstand damage that may occur from explosive or other forces that could rupture or damage the tanks.
- having the compartments and cylinders interconnected at only the lowest point in the tank helps to remove particulate and contaminate matter from within the tank. In addition, this may help to limit the creation of vapors within the tank and therefore minimise venting of these vapors.

BRIEF DESCRIPTION OF DRAWINGS

Further aspects of the present invention will become apparent from the ensuing description which is given by way of example only and with reference to the accompanying drawings in which.

BEST MODES FOR CARRYING OUT THE INVENTION

Figure 1:
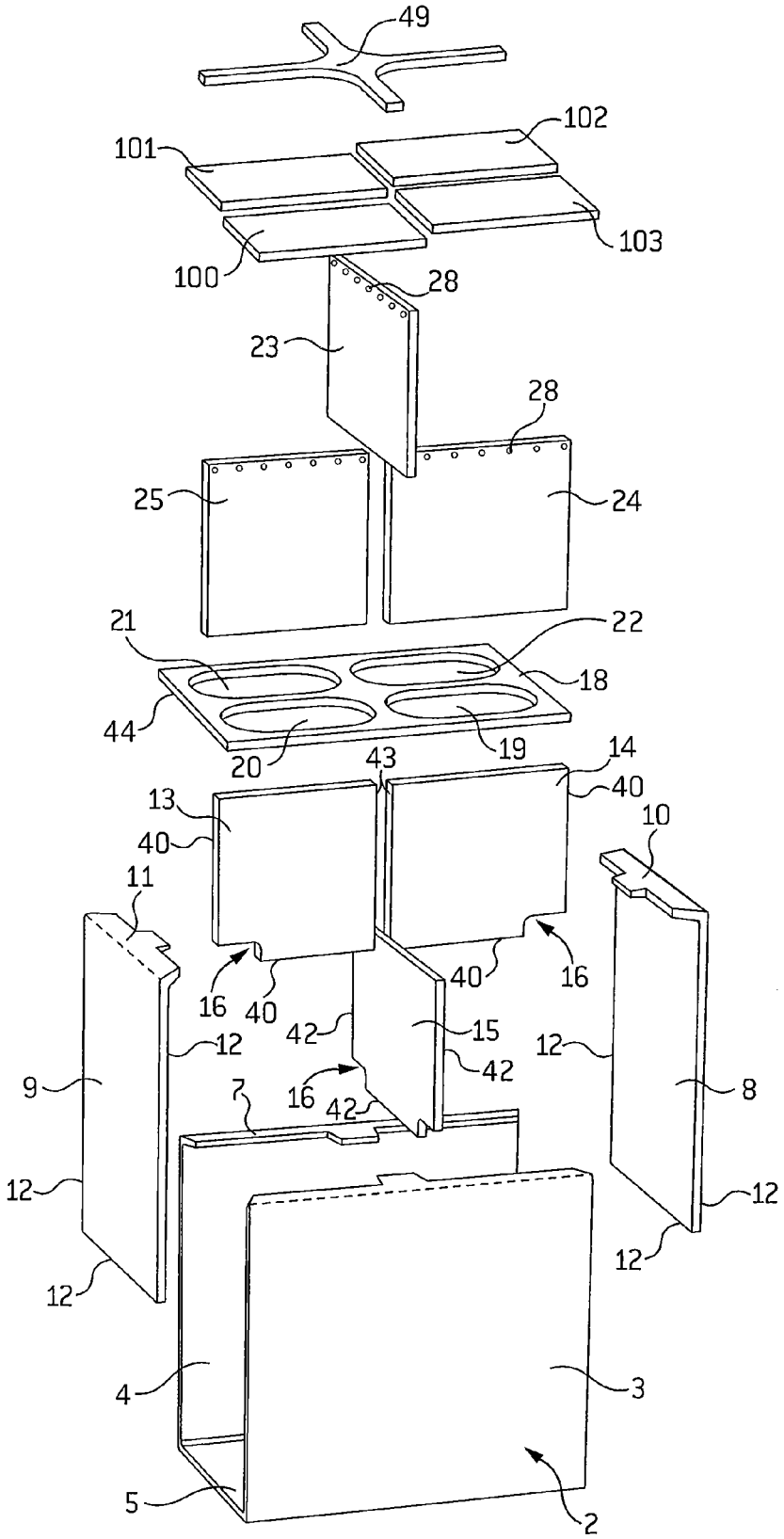
FIG. 1 is an exploded view of the component parts of a tank to be constructed according to one preferred embodiment of the present invention.
Figure 2:
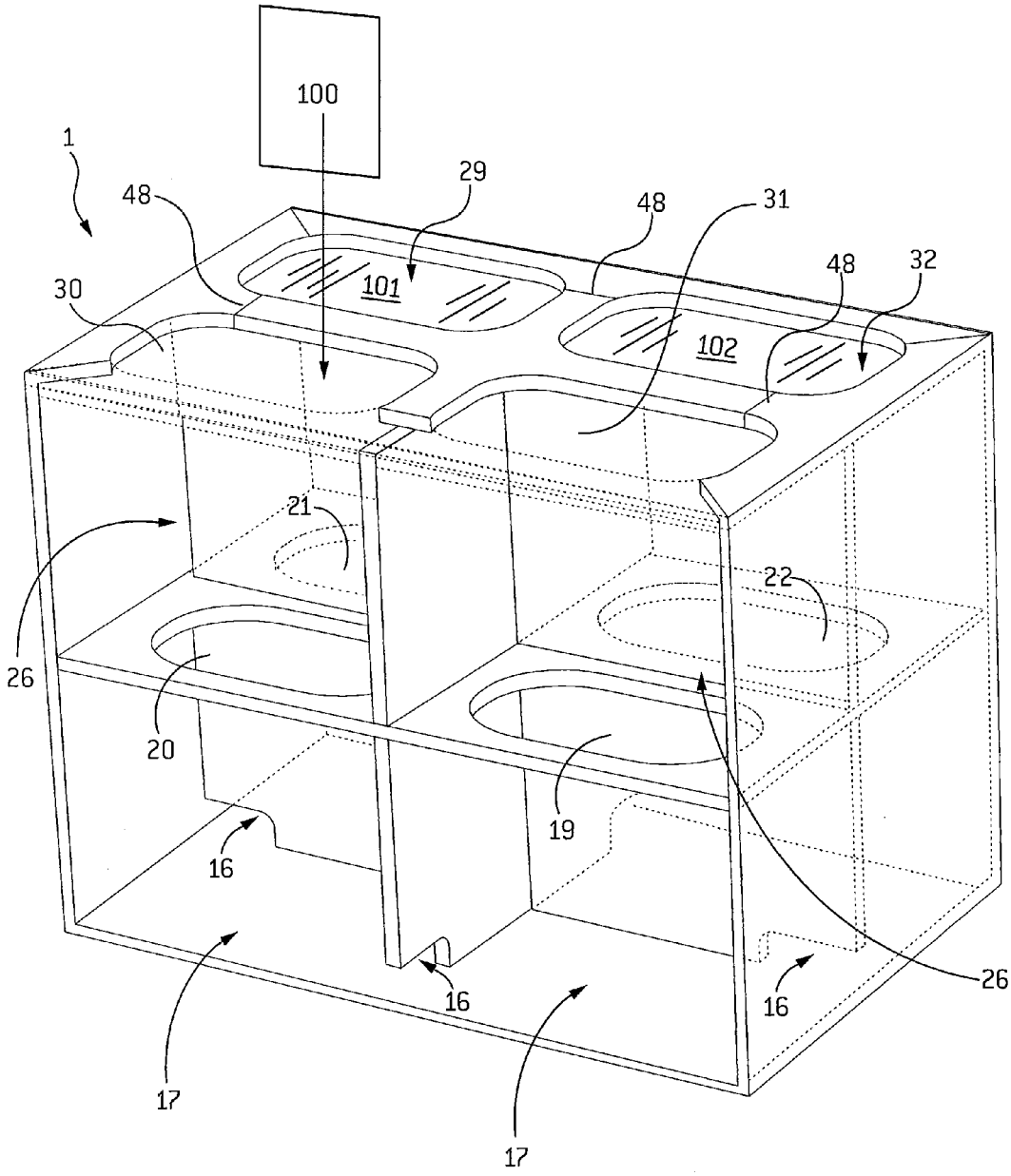
FIG. 2 is a cut-away view of a partially constructed tank built from the components shown in FIG. 1.

The following discussion of FIGS. 1 and 2 generally describes the features of the tank (1) in the order in which the tank is constructed.

The tank (1) is made from copolymer polypropylene.

A body portion (2) is initially formed by folding sheet material to provide side walls (3 and 4), and a base (5) of a tank (1).

The body portion (2) is folded to create a first pair of flanges (6 and 7) which extend over the top of the body portion (2).

End walls (8 and 9) are also formed from sheet material. The end walls (8 and 9) are folded to create a further pair of flanges (10 and 11). The flanges (10 and 11) extend over the newly formed tank (1).

The end walls (8 and 9) are secured by plastic welding along both the inside and outside edges (12) of the walls (8, 9) to complete the body portion (2).

Then substantially vertical longitudinal baffles (13 and 14) are positioned in the tank (1) and each side of edges (40) of the baffles (13, 14) is plastic welded to the base (5) and to the corresponding end walls (8 or 9).

A substantially vertical latitudinal baffle (15) is centrally positioned within the tank (1) and each side of the edges (42) of baffle (15) are plastic welded to the corresponding side walls (3, 4), and base (5).

The inner edges (43) of longitudinal baffles (13, 14) are also welded on either side to latitudinal baffles (15).

The baffles (13, 14, 15) have openings (16). The openings (16) interconnect the adjacent compartments (17) formed by baffles (13, 14, 15).

The openings (16) are such that they will be at the lowest point of the tank when a vehicle (not shown) in which the tank (1) is secured is in the vehicle's predominant in-use position.

A substantially horizontal baffle (18) is positioned and welded to either side of the latitudinal and longitudinal baffles (13, 14). The substantially horizontal baffle (18) has openings (19, 20, 21, 22). These openings (19, 20, 21, 22) that allow access below the baffle (18) so that it can be welded along the top and bottom edges (44), to the longitudinal and latitudinal baffles (13, 14, 15), the body portion (2), and end walls (8,9).

Latitudinal baffle (23) and longitudinal baffles (24 and 25) are then positioned in the tank (1) and plastic welded along either side of their edges to the side and end walls (3, 4), end walls (8 and 9) and substantially horizontal baffle (18): in much the same manner as described earlier for baffles (13, 14, 15). The top edge of baffles (23, 24, 25) fit substantially flush against the internal surface (not shown) of the flanges (6, 7) and (10, 11).

The baffles (23,24,25) divide the tank into compartments (26) of substantially equal volumes.

Thus, tank (1) has compartments (26) above and compartments (17) below that are connected by openings (19, 20, 21, 22).

The baffles (23, 24, 25) have breather holes (28) to equalise pressure within the compartments (26).

A cross member (49) is positioned and welded to the top edge of the baffles (23, 24, 25), and projecting edge (48) on flanges (6, 7, 10, 11).

It can be seen in FIG. 2 the cross member (49) and flanges (6,7,10,11) define openings (29, 30, 31, 32) in the top of the tank (1). It should be appreciated that the openings (29, 30, 31, 32) allow the cross member (49) to also be welded to the top edges of the transverse and longitudinal baffles (23, 24, 25). The tank is sealed by sheets of material (100, 101, 102 and 103) which have surface dimensions greater than those of openings (29, 30, 31, 32). The sheets of material (100, 101, 102 and 103) are each maneuvered so they can pass through their respective opening (29, 30, 31, 32) lengthways as illustrated by sheet of material (100) shown in FIG. 2. Once through openings (29, 30, 31, 32) the sheets of material are repositioned to close said opening, refer sheets (101, 102) in FIG. 2. The sheets (100, 101, 102 and 103) are then welded in place by a weld around the periphery of each opening (29, 30, 31, 32).

Figure 3:
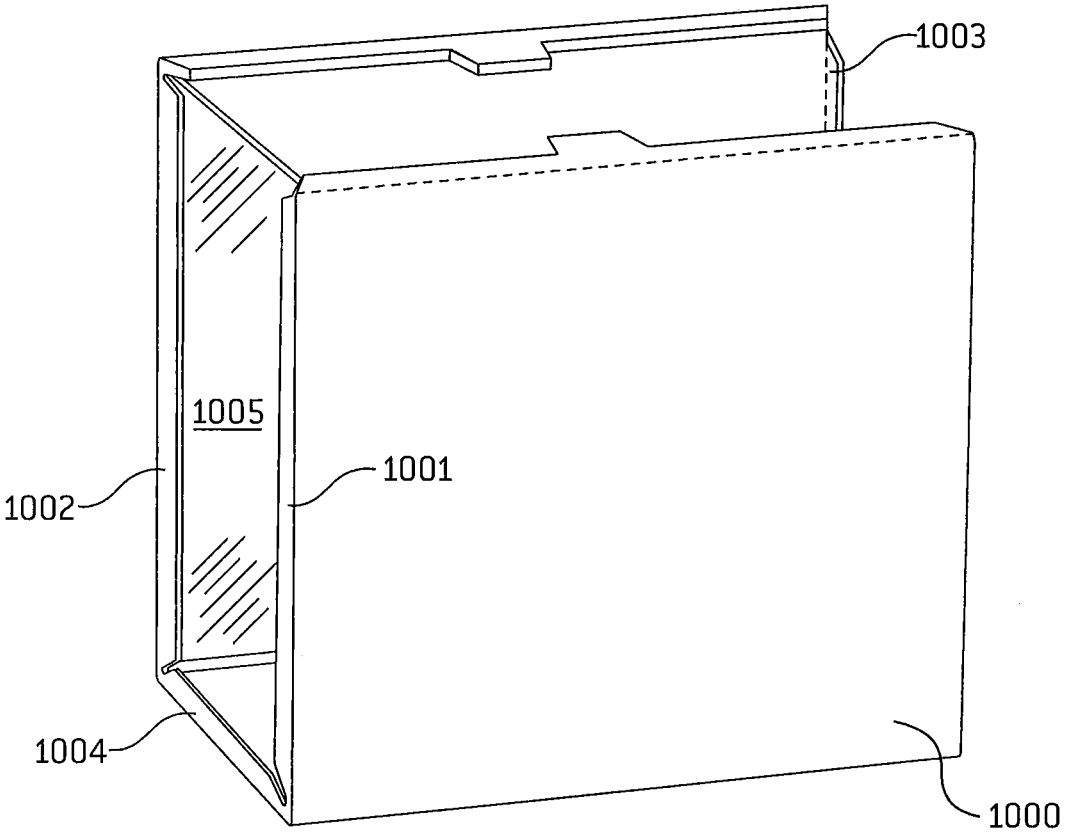
FIG. 3 shows an alternate embodiment for folding sheet material to form a body portion in accordance with the present invention.

In FIG. 3 the partially formed body portion (1000) is substantially identical to that shown in FIGS. 1 and 2 except it has been modified to include side flanges (1001, 1002, 1003) and (1004) (not shown) to which the outside surface of end walls of which only (1005) is shown, are welded to further increase the strength of the tank.

Aspects of the present invention have been described by way of example only and it should be appreciated that modifications and additions may be made thereto without departing from the scope thereof as defined in the appended claims.

What I claim is:

1. A method of constructing a tank, the tank comprising a body portion with a base, side walls, end walls, and at least one opening having edges, including the steps of:

(a) folding a single sheet of material to form the base and side walls of the tank;

(b) securing the end walls to the base and the side walls, wherein securing the end walls to base and the side walls forms a fluid-tight seal so that liquid or gas inside the tank cannot pass between the respective walls to exit the tank;

(c) forming flanges which extend across the base and define a portion of the at least one opening;

(d) inserting a single section of material into the body portion so as to be on the inside of the tank, wherein the single section of material has larger dimensions than the opening;

(e) positioning the single section of material to overlap the flanges; and (f) securing the single section of material to the body portion so that the single section of material acts as a barrier to material entering into or exiting from the tank via the at least one opening, wherein securing the single section of material to the body portion forms a fluid-tight seal so that liquid or gas inside the tank cannot pass between the single section of material and the body portion to exit the tank, wherein the step of forming the flanges involves folding the flanges from the same sheet of material as the side walls and the base to create side wall flanges which extend across the base, the ends walls are made from a separate sheet(s) of material to the side walls and base, and the step of forming the end wall flanges also forms projecting edges for the end wall flanges; and further including:

the step of folding the separate sheet(s) to create end wall flanges on the end walls that extend across the base; and step of securing a cross member to the flanges and the step of securing baffles to internal surfaces of the flanges, wherein collectively the cross member and the flanges define edges of the at least one opening, wherein the cross member and the flanges together define four openings.

2. The method as claimed in claim 1, wherein securing the separate sheets of material to the base and side walls involves welding along an internal edge between the sheet materials.

3. The method as claimed in claim 2, including the step of welding along an outside edge between the sheet materials.

4. The method as claimed in claim 1, including the step of folding the single sheet of material so as to form a top section of the tank such that edges of the sheet material are spaced apart so as to define the at least one opening.

5. The method as claimed in claim 4, including the step of securing a reinforcing element to an internal edge of the single sheet of material at a joint between the base and a side wall.

6. The method as claimed in claim 1, including the step of securing a conduit to the tank.

7. The method as claimed in claim 1, wherein the step of securing the end walls to the base and the side walls occurs before the step of securing the single section of material to the body portion.

8. The method as claimed in claim 1, including the stop of positioning and securing a baffle within the tank so that the baffle can have a substantially horizontal orientation when the tank is installed in a vehicle, wherein the step of positioning the baffle occurs before the step of securing the single section of material to the body portion.

9. The method as claimed in claim 1, including the step of securing a conduit to the body portion to enable controlled removal of liquid or gas from the tank.

10. The method as claimed in claim 1, wherein the step of inserting the single sheet of material through the opening ensures that the single sheet of material is entirely within the tank.

11. The method as claimed in claim 10, wherein the cross member and the flanges together define four openings.

12. The method as claimed in claim 11, including the step of securing baffles to internal surfaces of the flanges.

* * * * *